United States Patent [19]

Elsner

[11] 4,090,521

[45] May 23, 1978

[54] METHOD AND APPARATUS FOR COMMINUTING TOBACCO OR THE LIKE

[75] Inventor: Uwe Elsner, Dassendorf, Germany

[73] Assignee: Hauni-Werke Korber & Co. KG, Hamburg, Germany

[21] Appl. No.: 747,507

[22] Filed: Dec. 6, 1976

[30] Foreign Application Priority Data

Dec. 19, 1975 Germany ..... 2557313

[51] Int. Cl.[2] ..... A24B 1/02; B02C 4/32

[52] U.S. Cl. ..... 131/109 R; 198/577; 241/34; 19/105

[58] Field of Search ..... 131/109, 22 R; 198/577, 198/573, 856, 604, 626; 241/63, 64, 34; 19/98, 105

[56] References Cited

U.S. PATENT DOCUMENTS

| | | | |
|---|---|---|---|
| 2,732,138 | 1/1956 | Forth | 241/34 X |
| 3,276,452 | 10/1966 | Dearsley | 131/109 R |
| 3,801,024 | 4/1974 | Elsner | 241/34 |
| 3,829,164 | 8/1974 | Schoeb | 198/577 |

*Primary Examiner*—Stephen C. Pellegrino
*Attorney, Agent, or Firm*—Peter K. Kontler

[57] ABSTRACT

The chains which condense and advance a continuous cake of compacted tobacco into the range of orbiting knives in a tobacco shredding machine are driven by a reversible prime mover independently of the motor which drives the knives. When the movement of the prime mover in a direction to advance the tobacco cake into the range of the knives is interrupted, the prime mover is automatically started in reverse so that the chains retract the leader of the cake from the range of orbiting knives and thus prevent further comminution and eventual overheating and combustion of tobacco. The operation in reverse is terminated by a time-delay device when the leader of the cake is retracted from the range of orbiting knives to an extent which insures that automatic expansion of the leader toward the knives does not suffice to permit any contact between the cake and the orbiting knives while the chains are not driven in a direction to move the cake toward the knives.

11 Claims, 3 Drawing Figures

METHOD AND APPARATUS FOR COMMINUTING TOBACCO OR THE LIKE

BACKGROUND OF THE INVENTION

The present invention relates to a method and apparatus for comminution of fibrous materials, such as tobacco, and more particularly to improvements in a method and apparatus for shredding tobacco leaves or fragments of tobacco leaves.

A tobacco shredding apparatus normally comprises a rotary carrier for one or more knives which remove shreds from the leader of a continuous cake of compacted tobacco. The cake is formed and its contents compacted by a feeding device which preferably includes two chain conveyors or other types of conveyors defining a gradually narrowing path extending from a source (e.g., the lower end of a tobacco duct) to a comminuting station where the leader of the cake moves into the range of orbiting knives. As a rule, the knife carrier is driven by a first motor and the chain conveyors of the feeding device are driven by a second motor which can be started or arrested independently of the first motor. The knife or knives on the carrier are sharpened by a grinding wheel which is dressed by a diamond or the like and preferably (but not necessarily) receives torque from a separator motor.

Shredding apparatus of the just outlined character are often set up in groups of two, three or more, i.e., an entire battery of shredding apparatus can be employed to comminute large quantities of tobacco ahead of a conditioning unit which changes the moisture content and/or temperature of shreds and/or contacts the shreds with casing or other flavoring agents prior to introduction of shreds into the distributor of a machine for the production of plain cigarettes, cigarillos or cigars. Even minor defects of a shredding apparatus or of means for supplying tobacco to or for removing tobacco shreds from such apparatus normally necessitate an interruption of the feed of tobacco cake into the range of orbiting knives in the respective apparatus. Furthermore, the feed of tobacco cake to a shredding apparatus must be interrupted if the feeding means is to receive a different blend of two or more tobacco types. A short interruption of the feed does not necessarily (and normally does not) entail a stoppage of the knife carrier. Therefore, and since the leader of the compacted cake (whose forward progress has been interrupted in order to eliminate a defect or for other purposes) exhibits a strong tendency to expand, the front surface of the expanding leader moves into the range of the orbiting knives which remove (actually scrape) minute fragments of tobacco from the cake. The fragments are much smaller than normal tobacco shreds. Moreover, the expanding leader of an arrested tobacco cake moves into strong frictional engagement with the rapidly orbiting knives and/or with the rotating carrier whereby the aforementioned minute fragments undergo a pronounced drying and heating action. The heating action is so pronounced that the fragments of tobacco are likely to be combusted, for example, due to generation of sparks which develop on contact between the grinding wheel and the orbiting knives. Therefore, fires in conventional shredding apparatus and/or in filters which are used to intercept tobacco dust that is removed from shredding apparatus and the surrounding area are not uncommon. Such fires can cause extensive damage to tobacco and to equipment in a tobacco processing plant as well as prolonged interruptions of operation which is particularly undesirable when the shredding apparatus are installed in a complete production line.

SUMMARY OF THE INVENTION

An object of the invention is to provide a novel and improved method of preventing overheating and the attendant danger of burning of compacted tobacco or other fibrous material in a shredding or like comminuting apparatus.

Another object of the invention is to provide a novel apparatus which can be used for the practice of the improved method.

A further object of the invention is to provide a tobacco shredding apparatus with novel and improved means for preventing overheating of compacted tobacco on contact with comminuting instrumentalities when the forward transport of compacted tobacco is interrupted or terminated independently of the operation of means for driving the comminuting instrumentalities.

An additional object of the invention is to provide a novel and improved prime mover for tobacco feeding means in a shredding apparatus.

An ancillary object is to provide novel and improved control means for the prime mover.

A further object of the invention is to provide an apparatus of the above outlined character which constitutes a relatively simple but unobvious and advantageous modification of existing shredding apparatus.

Another object of the invention is to provide a shredding apparatus wherein the comminuting instrumentalities can remain in motion even during short-lasting or prolonged stoppage of tobacco feeding means.

One feature of the invention resides in the provision of a method of preventing overheating of fibrous material, particularly tobacco, on contact with driven comminuting instrumentalities which comminute the leader of a preferably continuous body or cake of compacted fibrous material while the body is moved in a direction toward the instrumentalities and the fibrous material of the leader tends to undergo a pronounced heating action as a result of automatic expansion of the leader toward the comminuting instrumentalities on termination of movement of the body in the aforementioned direction. The method comprises the steps of retracting the leader of the body in a direction away from the range of comminuting instrumentalities on termination of movement toward the instrumentalities, and terminating the retracting step when the leader is sufficiently remote from the instrumentalities to insure that mere expansion of the leader (without renewed forward movement of the body) does not suffice to move the leader back into the range of comminuting instrumentalities.

Another feature of the invention resides in the provision of apparatus for comminution of fibrous material, particularly of a tobacco shredding apparatus, which comprises comminuting means (e.g., one or more orbiting knives or analogous comminuting instrumentalities), a source of fibrous material spaced apart from the comminuting means, feeding means including conveyor means movable in a first direction to advance fibrous material from the source into the range of the comminuting means and in a second direction to withdraw the material from such range, means (e.g., a reversible prime mover or the first of two discrete prime movers)

for moving the conveyor means in the first direction, and control means including a disconnect switch or analogous means for deactivating the moving means and means for effecting the movement of the conveyor means in the second direction in response to deactivation of the moving means, preferably in immediate and automatic response to such deactivation. The movement effecting means may include means for operating the reversible prime mover in reverse or means for starting the second discrete prime mover. The apparatus preferably further comprises means for terminating the movement of conveyor means in the second direction after elapse of an interval which suffices to insure that the fibrous material is moved out of the range of the comminuting means, even if the leader of fibrous material in or on the conveyor means exhibits a pronounced tendency to expand toward the comminuting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
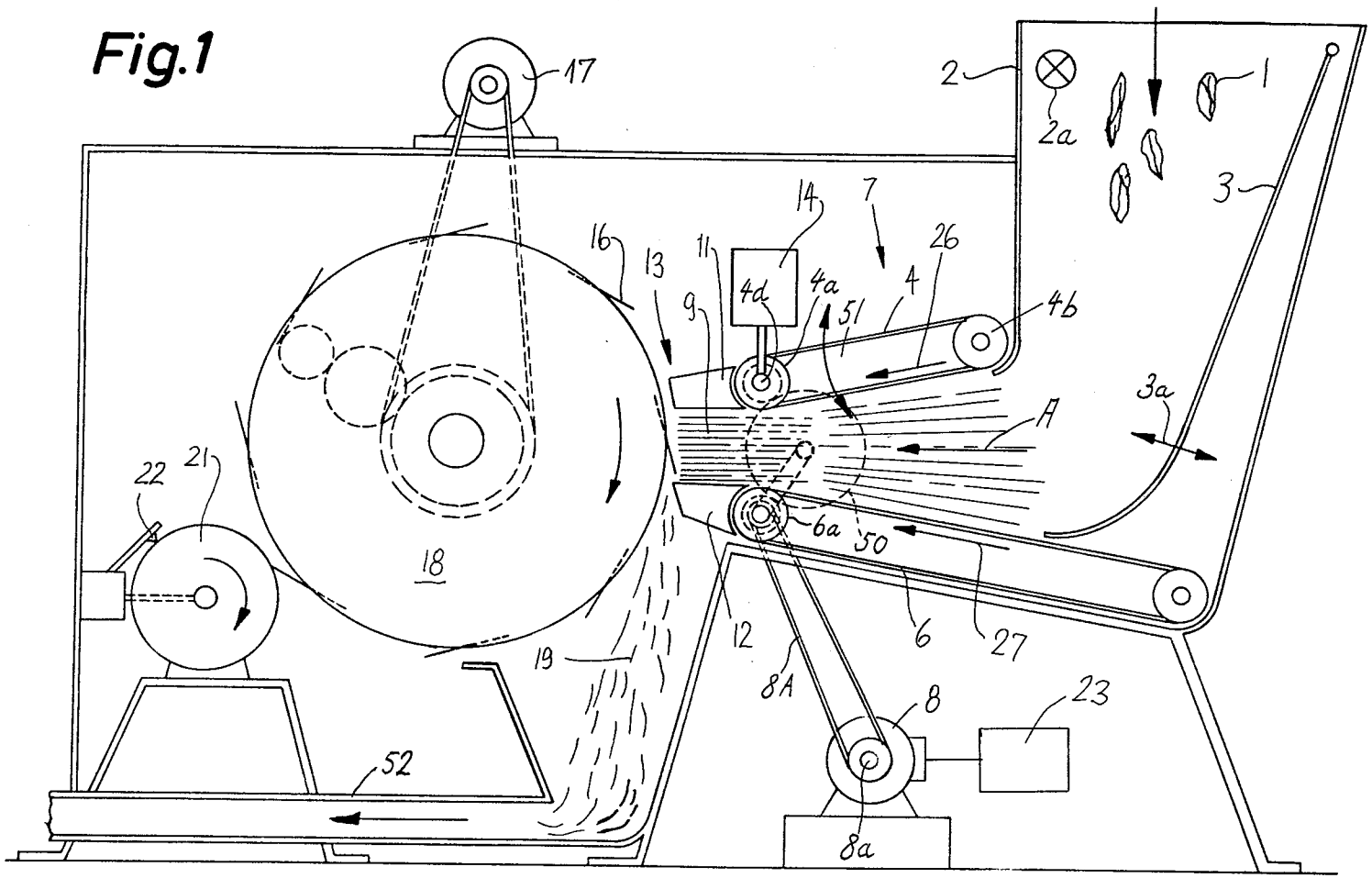
FIG. 1 is a schematic longitudinal vertical sectional view of an apparatus which embodies one form of the invention.

Referring to FIG. 1, there is shown a comminuting or shredding apparatus which comprises a source of tobacco leaves 1 or tobacco leaf laminae. The source includes a duct 2 which contains a pivotable rake 3 movable back and forth in directions indicated by double-headed arrow 3*a* to intermittently advance tobacco leaves 1 into the forwardly converging gap or path between the lower reach of an upper endless chain conveyor 4 and the upper reach of a lower endless chain conveyor 6. The conveyors 4 and 6 form part of a feeding device 7 which serves to form and compact a continuous tobacco body or cake 9 and to advance the cake in the direction of arrow A into the range of orbiting knives 16 on a rotary drum-shaped carrier 18. The duct 2 receives tobacco leaves 1 from a suitable metering device, not shown, which reduces the rate of tobacco delivery when the column of leaves reaches the level of a photoelectric monitoring device 2*a* and increases the rate of delivery when the light beam issuing from the light source of the monitoring device 2*a* can reach the associated photosensitive transducer. A shredding apparatus which is similar to that shown in FIG. 1 is known as type KT produced by Hauni-Werke Körber & Co. KG, Hamburg, Federal Republic Germany.

The means for moving the chain conveyors 4 and 6 so as to advance their tobacco-engaging reaches in directions indicated by arrows 26 and 27 includes a prime mover 8 whose output shaft 8*a* drives the front sprocket wheel 6*a* for the lower chain conveyor 6 through the medium of an endless belt or chain 8A. A gear on the shaft of the sprocket wheel 6*a* drives an intermediate gear 50 which is in mesh with a gear on the shaft 4*d* of the front sprocket wheel 4*a* for the upper chain conveyor 4. The shaft 4*d* of the sprocket wheel 4*a* is mounted on a frame 51 which is pivotable on the shaft for the rear sprocket wheel 4*b*. The shaft 4*d* is biased downwardly, as viewed in FIG. 1, by a dashpot 14 or other suitable means for urging the lower reach of the chain conveyor 4 against the upper side of the tobacco cake 9. The leader of the cake 9 passes through the sections 11 and 12 of a mouthpiece 13 on its way into the range of the orbiting knives 16. The shreds 19 descend into the inlet of a pneumatic conveyor pipe 52.

The carrier 18 for the knives 16 is driven by a separate prime mover 17 (preferably an electric motor) which is operated independently of the prime mover 8, i.e., the prime mover 8 can be arrested while the prime mover 17 continues to rotate the carrier 18, and vice versa. The knives 16 are sharpened by a rotary grinding wheel 21 whose peripheral surface is treated by a diamond 22 or another suitable dressing tool. The lower section 12 of the mouthpiece 13 constitutes a counterknife which cooperates with the orbiting knives 16 to sever the leader of the cake 9, i.e., to comminute the contents of the cake and to convert them into shreds 19. Such shreds can be transported into a conditioning apparatus, not shown. FIG. 1 further shows a control unit 23 which regulates the operation of the prime mover 8 in accordance with a feature of the invention.

Figure 2:
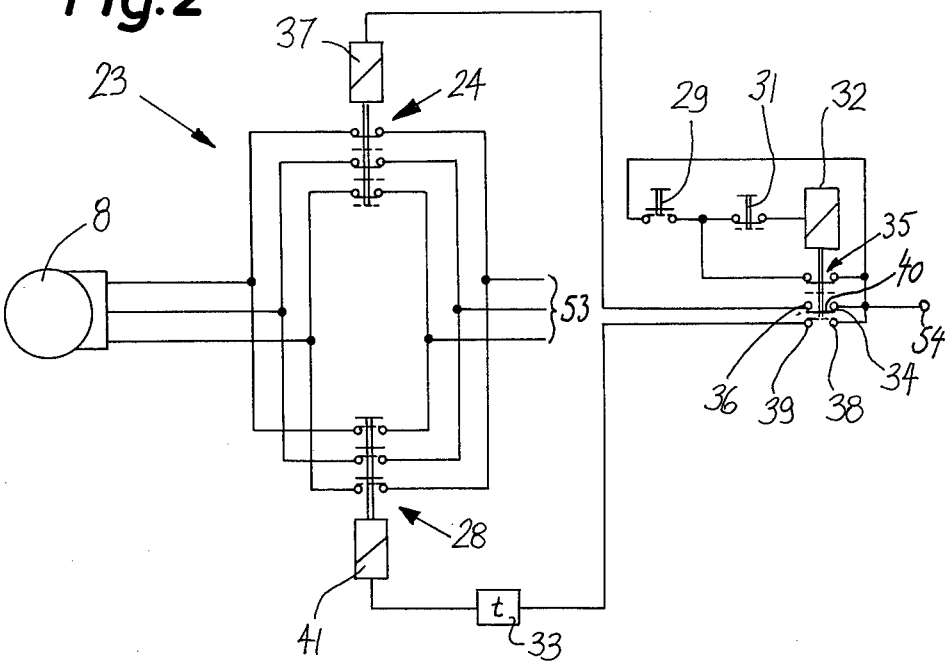
FIG. 2 is a circuit diagram of the control unit for the prime mover which drives the conveyor means of the feeding device in the apparatus of FIG. 1.

As shown in FIG. 2, the prime mover 8 is a reversible electric polyphase motor which is connectable in circuit with a source 53 of polyphase current and with two relays 24, 28 having electromagnets 37 and 41, respectively. When the electromagnet 37 is energized, the contacts of the relay 24 connect the motor 8 with the source 53 in such a way that the output shaft 8*a* of the motor drives the chain conveyors 4 and 6 in the directions indicated by arrows 26, 27, i.e., the cake 9 moves forwardly and advances its leader into the range of the knives 16. When the electromagnet 41 is energized, the motor 8 is connected in circuit with the energy source 53 in such a way that the output shaft 8*a* rotates in the opposite direction, i.e., the tobacco-contacting reaches of the chain conveyors 4 and 6 move the cake 9 in a direction away from the comminuting station (mouthpiece 13).

The means for energizing the electromagnet 37 or 41 includes a normally open starter switch 29 which is in series with a normally closed disconnect or deactivating switch 31 and the winding of a relay 32 having a holding contact 35 and a second contact 40. The relay 32 is energized in response to momentary closing of the normally open switch 29 whereby the holding contact 35 assumes the solid-line position of FIG. 2 and remains in such position until the operator decides to open the disconnect switch 31. When the holding contact 35 assumes the solid-line position of FIG. 2, i.e., when the winding of the relay 32 is energized, the other contact 40 assumes the solid-line position and engages the terminals 34, 36 to thus complete the circuit of the electromagnet 37 which causes the output shaft 8*a* to rotate in a direction to move the cake 9 forwardly toward the comminuting station. When the attendant decides to terminate the feed of cake 9 toward the orbiting knives 16, the disconnect switch 31 is moved to the broken-line position to thereby deenergize the winding of the relay 32 whereby the latter moves the holding contact 35 to the broken-line position and causes the contact 40 to engage the terminals 38, 39. This opens the circuit of the electromagnet 37 and simultaneously completes the circuit of the electromagnet 41. Thus, the motor 8 is operated in reverse and the chain conveyors 4 and 6 move the leader of the cake 9 away from the comminuting station. A time delay device 33 which is in circuit with the electromagnet 41 interrupts the connection between this electromagnet and the energy source (one pole of which is shown at 54) after a predetermined interval of time which is long enough to insure that the leader of the cake 9 cannot move into the path of orbiting knives 16 (the motor 17 is assumed to be on while the motor 8 is arrested, operated in a direction to move the cake forwardly or to retract the leader of the cake from the comminuting station) even if the strongly compacted material of the leader undergoes a pronounced expansion or bulging in a direction toward the path of the knives 16 immediately downstream of the mouthpiece 13.

When the malfunction which necessitated temporary stoppage of the motor 8 is eliminated, the attendant simply depresses the starter switch 29 which energizes the winding of the relay 32 to return the holding contact 35 to the solid-line position and to thereby engage the contact 40 with the terminals 34, 36. Thus, the electromagnet 37 is energized and the contacts of the relay 24 cause the motor 8 to rotate the output shaft 8*a* in a direction to move the cake 9 forwardly.

The time-delay device 33 is preferably adjustable so as to enable the attendant to select the interval of time during which the motor 8 is operated in reverse.

Figure 3:
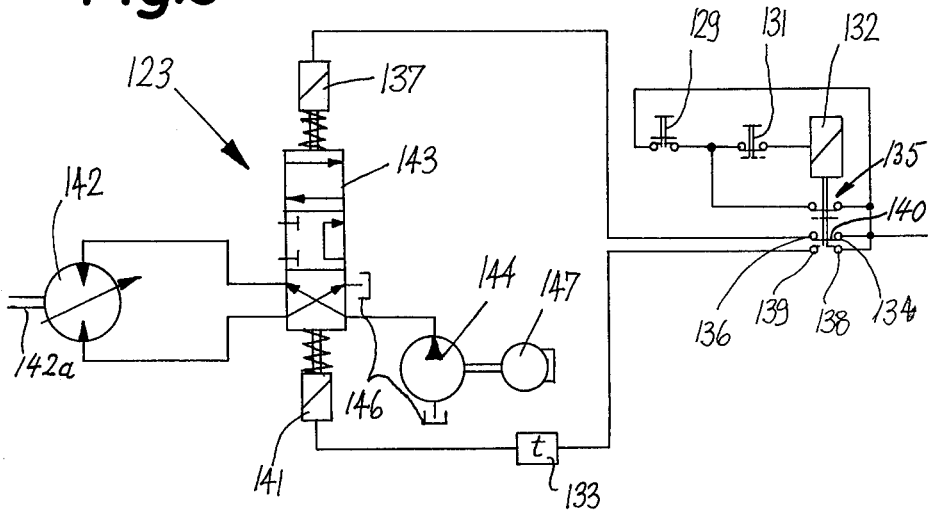
FIG. 3 is a diagram of the control unit for a fluid-operated prime mover which can be used as a substitute for the prime mover of FIG. 2.

FIG. 3 shows a modified reversible prime mover 142 which is a fluid-operated motor, preferably a hydraulic motor. All such components of the control unit 123 for the motor 142 which are identical with or clearly analogous to corresponding components of the control unit 23 are denoted by similar reference characters plus 100.

The ports of the motor 142 are connected with a multi-way valve 143 whose valve element (e.g., a reciprocable spool) tends to assume a neutral position in which the motor 142 is sealed from a source of pressurized fluid (here shown as a pump 144 driven by a motor 147 and adapted to draw fluid from a reservoir or tank 146). The valve elment of the valve 143 is movable in a first direction in response to energization of a first solenoid 137 whereby the valve 143 admits to the motor pressurized fluid in a sense to drive the output element 142*a* in a direction which is necessary to advance the cake 9 toward the orbiting knives 16. When the valve element of the valve 143 is moved in the opposite direction in response to energization of a second solenoid 141, the output element 142*a* drives the chains 4 and 6 in a direction to retract the leader of the cake 9 away from the comminuting station. The solenoid 141 is thereupon deenergized after a preselected interval of time by a preferably adjustable time-delay device 133.

The construction of that portion of the control unit 123 which is used to energize the solenoid 137 or 141 is identical with the construction of the corresponding part of the control unit 23. Thus, the starter switch 129 is normally open, the disconnect or deactivating switch 131 is normally closed, the holding contact 135 of the relay 132 assumes the solid-line position of FIG. 3 when the solenoid 137 is energized, and the contact 140 engages the terminals 138, 139 when the solenoid 141 is energized. The valve element of the valve 143 automatically assumes its neutral position (in which the motor 142 is sealed from the source 144, 147 of pressurized fluid) when the solenoids 137, 141 are deenergized, i.e., subsequent to deenergization of solenoid 141 by the time-delay device 133.

When the attendant opens the disconnect switch 131, the deenergization of solenoid 137 is immediately followed by return movement of valve element of the valve 143 to the neutral position, and such movement of the valve element is immediately followed by movement to other end position in response to energization of the solenoid 141. Thus, each reversal in the direction of rotation of the output shaft 142*a* is preceded by complete stoppage of the motor 142 due to movement of the valve element of the valve 143 to the neutral position.

When the valve element of the valve 143 assumes its neutral position, the pump 144 (which is continuously driven by the motor 147) causes a suitable relief valve (not shown) to open and to permit pressurized fluid to flow into the tank 146.

The shredding apparatus may comprise two prime movers for the chain conveyors 4 and 6. One prime mover serves to drive the chain conveyors 4 and 6 in the directions indicated by arrows 26, 27 and the other prime mover drives the chain conveyors in the opposite directions. The control unit for such prime movers includes means for starting the other prime mover in response to stoppage of the one prime mover and for maintaining the other prime mover in operation for an interval of time which is long enough to insure that the retracted leader of the cake 9 cannot reach the path of orbiting knives 16 even if the material of the cake undergoes a very pronounced expansion while the chain conveyors are idle.

An important advantage of the improved method and apparatus is that they invariably prevent overheating of tobacco when the prime mover means for the chain conveyors is or are idle, regardless of the duration of stoppage and regardless of the extent to which the cake is likely to expand in a direction toward the comminuting instrumentalities. This practically eliminates the danger of fire, even if the motor which drives the comminuting instrumentalities remains in operation while the prime mover means for the chain conveyors remains or remain idle for extended periods of time and irrespective of the possibility of generation of sparks as a result of grinding of the orbiting comminuting instrumentalities while the chain conveyors are at a standstill. Moreover, the likelihood of excessive and unnecessary comminution of tobacco during stoppage of the feeding device 7 is eliminated in a simple and reliable way.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In an apparatus for comminution of fibrous material, particularly in a tobacco shredding apparatus, a combination comprising a source of fibrous material; comminuting means spaced apart from said source; feeding means including conveyor means movable in a first direction to advance fibrous material from said source into the range of said comminuting means and in a second direction to withdraw the material from said range; means for moving said conveyor means in said first direction; and control means including means for deactivating said moving means and means for effecting the movement of said conveyor means in said second direction in response to deactivation of said moving means.

2. A combination as defined in claim 1, wherein said comminuting means comprises a rotary carrier, at least one knife mounted on said carrier, and means for rotating said carrier independently of said moving means.

3. A combination as defined in claim 1, further comprising means for terminating the movement of said conveyor means in said second direction after elapse of an interval which suffices to move the fibrous material out of the range of said comminuting means.

4. A combination as defined in claim 1, wherein said conveyor means comprises a pair of endless conveyors defining a path wherein fibrous material normally advances from said source into said range and which narrows in a direction toward said range so that the material in said path undergoes compression on its way toward said comminuting means.

5. A combination as defined in claim 1, wherein said moving means comprises a reversible prime mover having output means rotatable in third and fourth directions to thereby respectively move said conveyor means in said first and second directions, said deactivating means including means for interrupting the rotation of said output means in said third direction and said movement effecting means including means for setting said prime mover in operation in reverse so as to rotate said output means in said fourth direction.

6. A combination as defined in claim 5, wherein said prime mover is an electric motor.

7. A combination as defined in claim 5, wherein said prime mover is a fluid-operated motor.

8. A combination as defined in claim 5, further comprising means for automatically arresting said prime mover after a predetermined interval of rotation of said output means in said fourth direction.

9. A combination as defined in claim 1, wherein said movement effecting means includes at least one relay.

10. A combination as defined in claim 1, wherein said movement effecting means includes a valve.

11. A method of preventing overheating of fibrous material, particularly tobacco, on contact with driven comminuting instrumentalities which comminute the leader of a continuous body of compacted fibrous material while the body is moved in a direction toward said instrumentalities and the material of the leader of said body tends to undergo a pronounced heating action as a result of automatic expansion toward and into contact with said instrumentalities on termination of movement in said direction, comprising the steps of retracting the leader of said body in a direction away from said instrumentalities in response to termination of said movement; and terminating said retracting step when the leader is sufficiently remote from said instrumentalities to insure that expansion of the leader does not result in movement of the leader into the range of said instrumentalities.

* * * * *